US010518427B2

(12) United States Patent
Skuhra

(10) Patent No.: US 10,518,427 B2
(45) **Date of Patent: *Dec. 31, 2019**

(54) INSULATIVE LINER FOR A HAIR CLIPPER

(71) Applicant: ANDIS COMPANY, Sturtevant, WI (US)

(72) Inventor: Andrew A. Skuhra, Mount Pleasant, WI (US)

(73) Assignee: Andis Company, Sturtevant, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/095,535

(22) PCT Filed: Apr. 21, 2017

(86) PCT No.: PCT/US2017/028963

§ 371 (c)(1),
(2) Date: Oct. 22, 2018

(87) PCT Pub. No.: WO2017/185045

PCT Pub. Date: Oct. 26, 2017

(65) Prior Publication Data

US 2019/0126501 A1 May 2, 2019

Related U.S. Application Data

(60) Provisional application No. 62/326,485, filed on Apr. 22, 2016.

(51) Int. Cl.

| | |
|---|---|
| ***B26B 19/38*** | (2006.01) |
| ***B26B 19/28*** | (2006.01) |
| ***B26B 19/06*** | (2006.01) |

(52) U.S. Cl.
CPC ..... *B26B 19/3866* (2013.01); *B26B 19/06* (2013.01); *B26B 19/28* (2013.01); *B26B 19/3853* (2013.01); *B26B 19/3886* (2013.01)

(58) Field of Classification Search
CPC . B26B 19/3866; B26B 19/06; B26B 19/3886; B26B 19/28; B26B 19/3853
See application file for complete search history.

(56) References Cited

U.S. PATENT DOCUMENTS

| | | | | |
|---|---|---|---|---|
| 2,597,552 A | | 5/1952 | Wagner | |
| 3,458,737 A | * | 7/1969 | Lookman | B26B 19/28 310/51 |

(Continued)

FOREIGN PATENT DOCUMENTS

| | | |
|---|---|---|
| CN | 101454127 | 6/2009 |
| CN | 104044158 | 9/2014 |
| EP | 2198741 | 6/2010 |

OTHER PUBLICATIONS

International Search Report and Written Opinion for Application No. PCT/US2017/028963 dated Jul. 10, 2017 (12 pages).

*Primary Examiner* — Hwei-Siu C Payer
(74) *Attorney, Agent, or Firm* — Reinhart Boerner Van Deuren s.c.

(57) ABSTRACT

A hair grooming device includes a body having a lower housing and a removable cover, the lower housing defining a substantially hollow cavity. The lower housing is formed of a first material. A liner is received by the lower housing in the cavity. The liner is formed of a second material, the second material is different than the first material.

33 Claims, 7 Drawing Sheets

(56) References Cited

U.S. PATENT DOCUMENTS

| | | | | |
|---|---|---|---|---|
| 3,589,007 | A * | 6/1971 | Walton | B26B 19/06 30/140 |
| 3,992,778 | A | 11/1976 | Urbush | |
| 4,251,915 | A | 2/1981 | Ullmann | |
| 4,604,800 | A | 8/1986 | Yamamoto et al. | |
| 5,574,253 | A | 11/1996 | Golob et al. | |
| 5,787,587 | A | 8/1998 | Wahl et al. | |
| 6,112,414 | A | 9/2000 | Andis et al. | |
| 6,901,664 | B2 | 6/2005 | Melton et al. | |
| 7,246,441 | B1 | 7/2007 | Collins | |
| 7,794,276 | B2 | 9/2010 | Shigeta et al. | |
| 8,533,960 | B1 | 9/2013 | Barish | |
| 9,038,276 | B2 * | 5/2015 | Arndt | B26B 19/3866 30/208 |
| 10,059,013 | B2 * | 8/2018 | Skuhra | B26B 19/3866 |
| 2006/0059696 | A1 | 3/2006 | Derby et al. | |
| 2007/0213742 | A1 | 9/2007 | Callahan | |
| 2009/0199412 | A1 | 8/2009 | Cheng | |
| 2013/0067752 | A1 | 3/2013 | Buck, Jr. | |
| 2014/0259691 | A1 | 9/2014 | Arndt et al. | |
| 2016/0303749 | A1 * | 10/2016 | Ziegler | B26B 19/06 |
| 2019/0126501 | A1 * | 5/2019 | Skuhra | B26B 19/3866 |

* cited by examiner

INSULATIVE LINER FOR A HAIR CLIPPER

CROSS-REFERENCE TO RELATED APPLICATIONS

This application is a national stage filing under 35 U.S.C. 371 of International Patent Application No. PCT/US2017/028963, filed on Apr. 21, 2017 and entitled "Insulative Liner for a Hair Clipper," which claims the benefit of and priority to U.S. Provisional Patent Application No. 62/326,485, filed on Apr. 22, 2016 and entitled "Insulative Liner for a Hair Clipper." This application is also related to U.S. Pat. No. 10,059,013, filed on Apr. 21, 2017, which also claims priority to U.S. Provisional Patent Application No. 62/326,485. The contents of the above applications are hereby incorporated by reference in their entirety.

FIELD OF THE DISCLOSURE

The present invention relates to a liner for a hair clipper that provides electrical insulation, thermal insulation, dampens vibration, and reduces excess sound during operation.

SUMMARY

In one embodiment, the invention provides a hair grooming device that includes a body having a lower housing and a removable cover, the lower housing defining a substantially hollow cavity. The lower housing is formed of a first material. A liner is received by the lower housing in the cavity. The liner is formed of a second material, the second material is different than the first material. In some embodiments, the first material is aluminum or plastic, while the second material is glass filled nylon.

In other embodiments, the hair grooming device includes a drive assembly positioned within the cavity, and the liner is positioned between drive assembly and the lower housing. The liner can be configured to reduce the transfer of heat generated by the drive assembly to the lower housing. The liner can also be configured to absorb heat generated by the drive assembly.

In yet other embodiments, the hair grooming device can further include a cutting head assembly that is configured to cut hair. The liner can be configured to reduce the transfer of heat generated by the cutting head assembly to the drive assembly.

In some embodiments, the liner can be configured to dampen vibration generated by the drive assembly by reducing the transfer of vibration from the drive assembly to the lower housing. The liner can also be configured to reduce sound by absorbing sound generated by the drive assembly.

In other embodiments, the liner can be configured to electrically insulate the drive assembly and the lower housing by limiting the transfer of electricity there between. The liner can also include a plurality of electrically isolated compartments to electrically insulate components positioned within the hollow cavity.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

For ease of discussion and understanding, the following detailed description will refer to and illustrate the insulative liner innovation in association with a "hair clipper." It should be appreciated that a "hair clipper" is provided for purposes of illustration, and the insulative liner disclosed herein can be used in association with any hair cutting, hair trimming, or hair grooming device. Accordingly, the term "hair clipper" is inclusive, and refers to any hair grooming device that can include the insulative liner innovation disclosed herein, including, but not limited to, a hair trimmer, a hair clipper, or any other hair cutting or hair grooming device. In addition, the hair grooming device can be suitable for a human, animal, or any other suitable living or inanimate object having hair.

The present invention provides a liner for a hair clipper 10. The liner is positioned in a body 14 of the hair clipper 10, and provides insulating properties. For example, the liner provides electrical insulation, thermal insulation, dampens vibration, and reduces audible sound.

Figure 1:
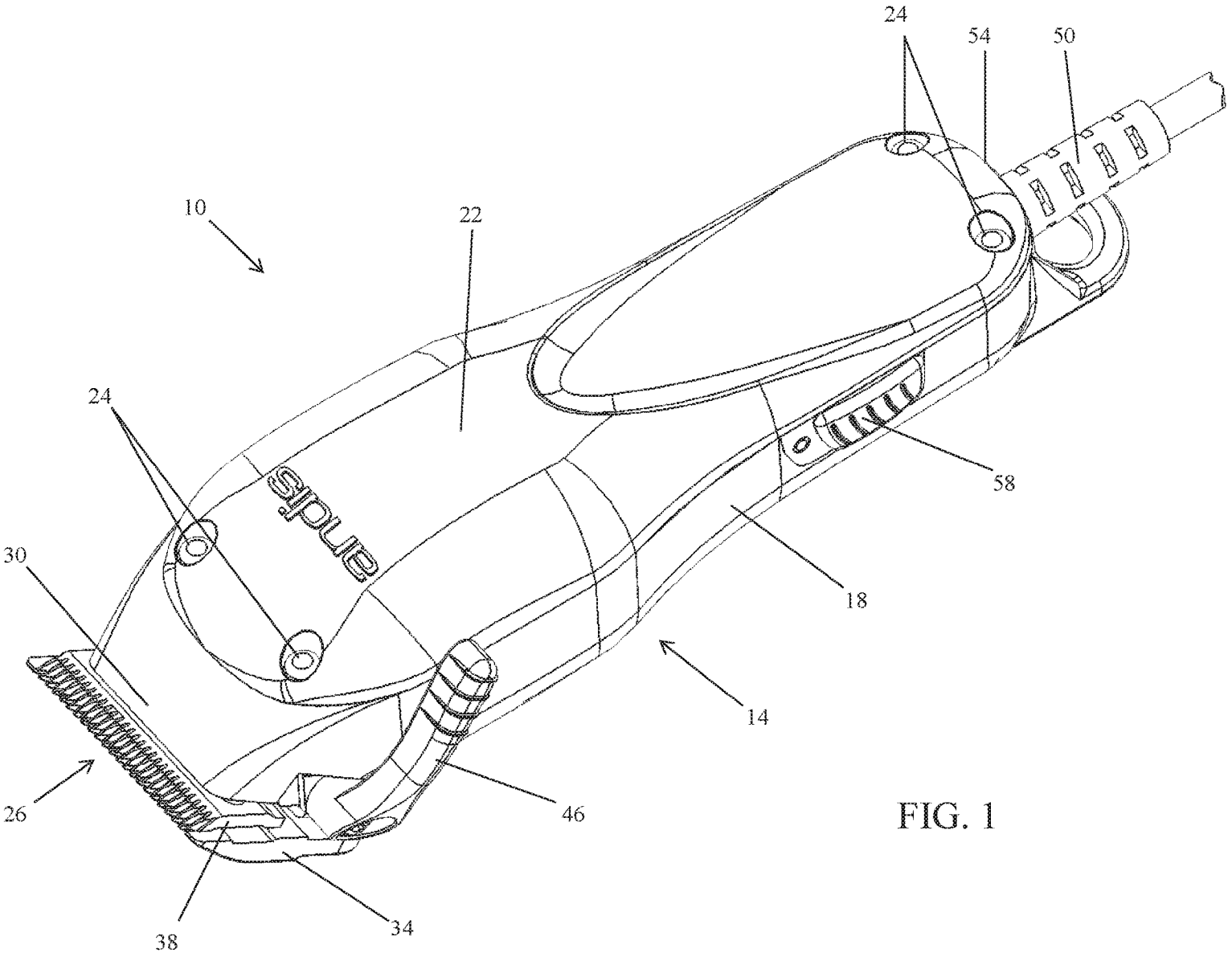
FIG. 1 is a perspective view of a hair clipper embodying the invention.

FIG. 1 illustrates an example of an embodiment of the hair clipper 10 having the hand-held body 14. The body 14 is defined by a lower or first housing 18 and a removable cover 22. A plurality of fasteners 24 (e.g., bolts, screws, etc.) couple the cover 22 to the lower housing 18. A cutting head assembly 26 is coupled to a first end 30 of the body 14. The cutting head assembly 26 includes a lower plate 34 and an upper plate or cutter 38. The upper plate 38 is supported on the lower plate 34, and is movable with respect to the lower plate 34. The upper plate 38 can define a drive socket (not shown) that is configured to engage a reciprocating or oscillating drive assembly 42 (shown in FIG. 2). The drive assembly 42 is configured to generate oscillating or reciprocating movement of the cutting head assembly 26 to facilitate cutting of hair.

A taper lever 46 is operably connected to the cutting head assembly 26. The taper lever 46 adjusts the position of one of the lower or upper plate 34, 38 in relation to the other of the upper or lower plate 38, 34. For example, rotation of the taper lever 46 towards the cutting head assembly 26 (e.g., counter-clockwise as viewed in FIG. 1) results in a shorter cut, as the edges of the lower and upper plates 34, 38 are in close proximity (or at a reduced distance) to one another. FIG. 1 illustrates the cutting head assembly 26 configured to make the shorter cut. Rotation of the taper lever 46 away from the cutting head assembly 26 (e.g., clockwise as viewed in FIG. 1) results in a longer cut, as one of the lower or upper plates 34, 38 is repositioned away from the other of the upper or lower plates 38, 34, resulting the edges of the lower and upper plates 34, 38 being separated or offset from each other (or separated by a greater distance or not in close proximity).

A power source, illustrated as an electric cord 50, extends from a second end 54 of the body 14. The cord 50 is configured to connect to a suitable source of power (e.g., an outlet, etc.). In other embodiments, the power source can be a battery (or rechargeable battery) that is positioned in the body 14. A switch 58 is positioned on the body 14 (and more specifically the lower housing 18) for powering the drive assembly 42 (shown in FIG. 2) "on" or "off" The switch 58 is user operable, for example it can be actuated by a thumb of the user. Positioning the switch 58 into the "on" position provides power to the drive assembly 42, while positioning the switch 58 into the "off" position terminates power to the drive assembly 42.

Figure 2:
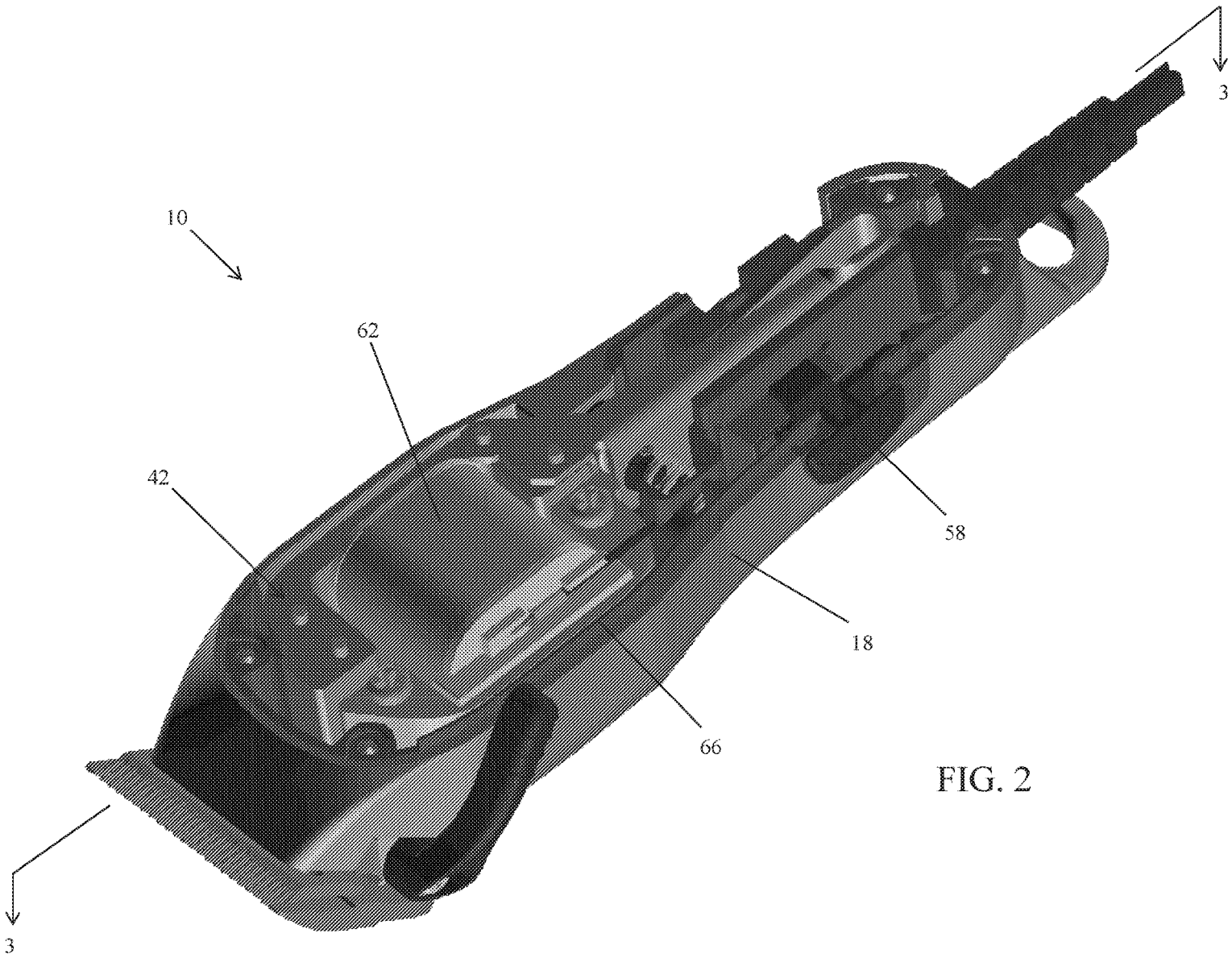
FIG. 2 is a perspective view of the hair clipper of FIG. 1 with the cover removed.
Figure 3:
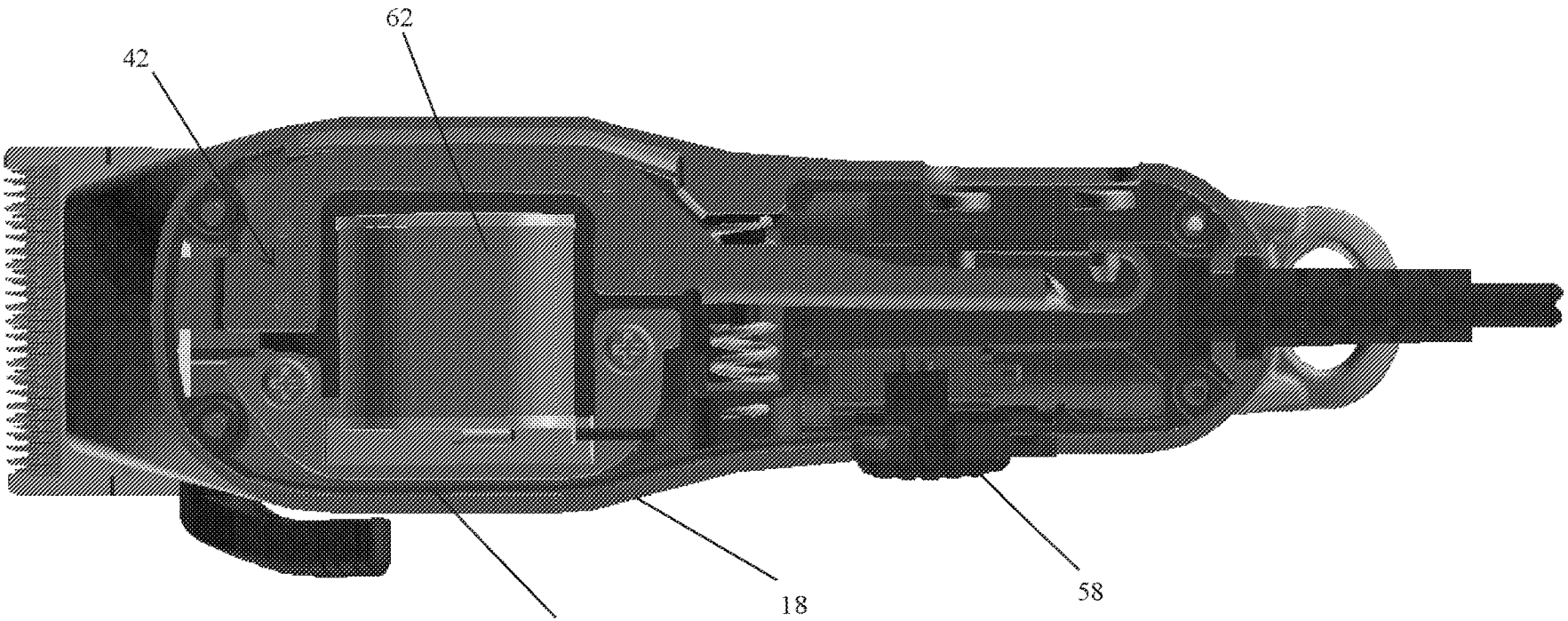
FIG. 3 is a plan view of the hair clipper of FIG. 2, taken along line 3-3 of FIG. 2.

Referring to FIGS. 2-3, the hair clipper 10 is depicted with the cover 22 removed to illustrate the drive assembly 42. In the illustrated embodiment, the lower housing 18 contains the drive assembly 42, which includes an electric motor 62. The electric motor 62 illustrated in FIG. 2 is a magnetic motor 62. However, in other examples of embodiments, the electric motor 62 can be a pivot motor, a rotary motor, or any other suitable motor for generating oscillating or reciprocating movement of the cutting head assembly 26.

Referring now to FIGS. 4-7, the hair clipper 10 is depicted with both the cover 22 and the drive assembly 42 removed. The lower housing 18 defines a substantially hollow first cavity 64 (shown in FIG. 5) that is configured to receive a liner 66. The liner 66 is an insulative liner 66 that nests into the lower housing 18. The insulative liner 66 defines a substantially hollow second cavity 70 (shown in FIG. 5) that is complimentary to first cavity 64. Stated another way, when the lower housing 18 receives the insulative liner 66, the first and second cavities 64, 70 define a hollow portion or volume 74 that is configured to receive the drive assembly 42 (as shown in FIG. 3). In addition to being nested in the lower housing 18, the insulative liner 66 can be encased or partially enclosed by or sandwiched between the cover 22 (shown in FIG. 1) and the lower housing 18. Stated another way, the cover 22 and the lower housing 18 cooperate to hold the insulative liner 66 in place in relation to the lower housing 18. In addition, or alternatively, the insulative liner 66 can be further attached to (or engaged with) the lower housing 18 by the plurality of fasteners 24. To facilitate the attachment, the insulative liner 66 and the lower housing 18 can each include apertures that align when the insulative liner 66 is nested within the lower housing 18. Once aligned, each set of apertures can then receive a corresponding fastener 24.

Figure 4:
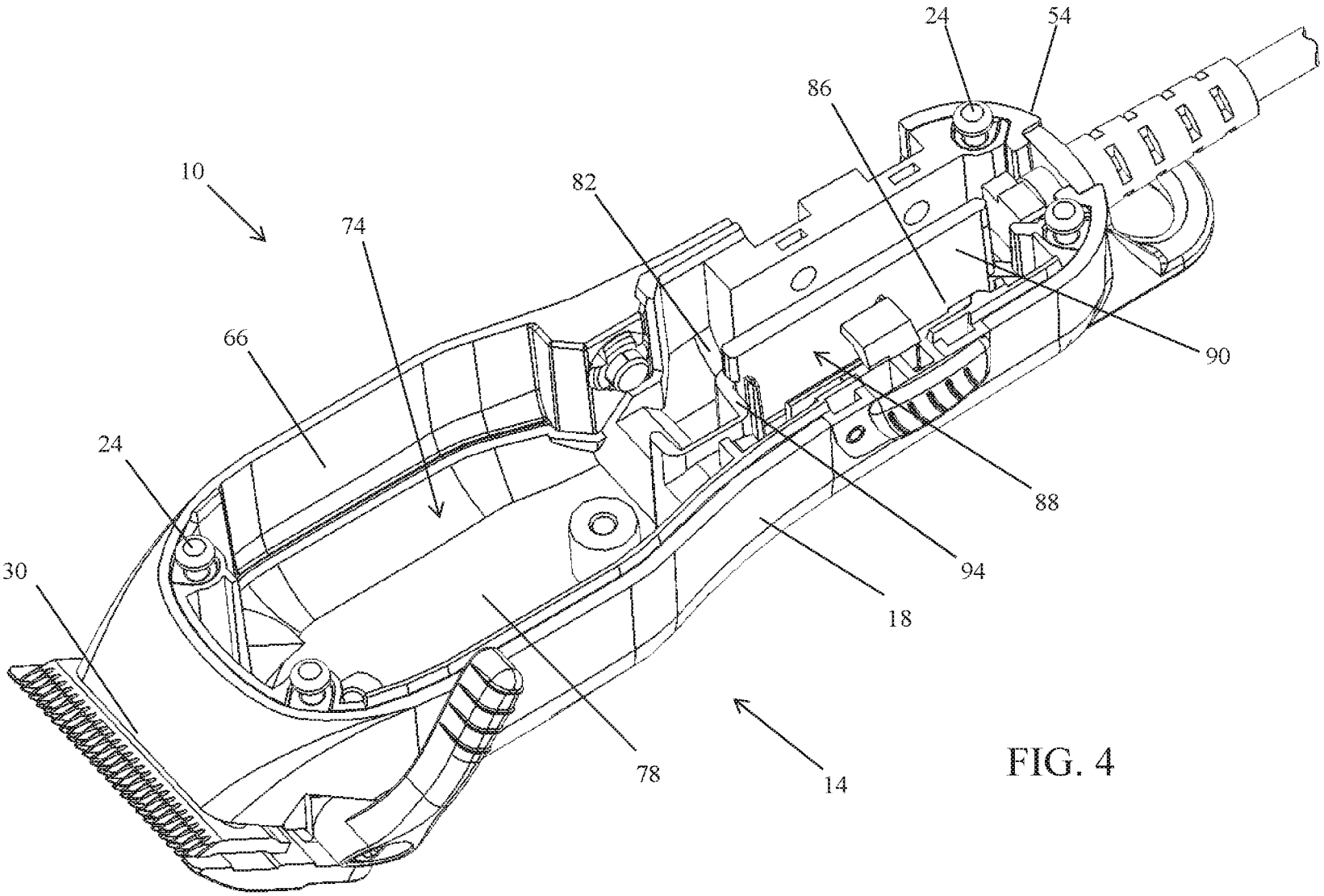
FIG. 4 is a perspective view of the hair clipper of FIG. 1, with both the cover and the drive assembly removed to illustrate the insulative liner nested in the lower housing.
Figure 5:
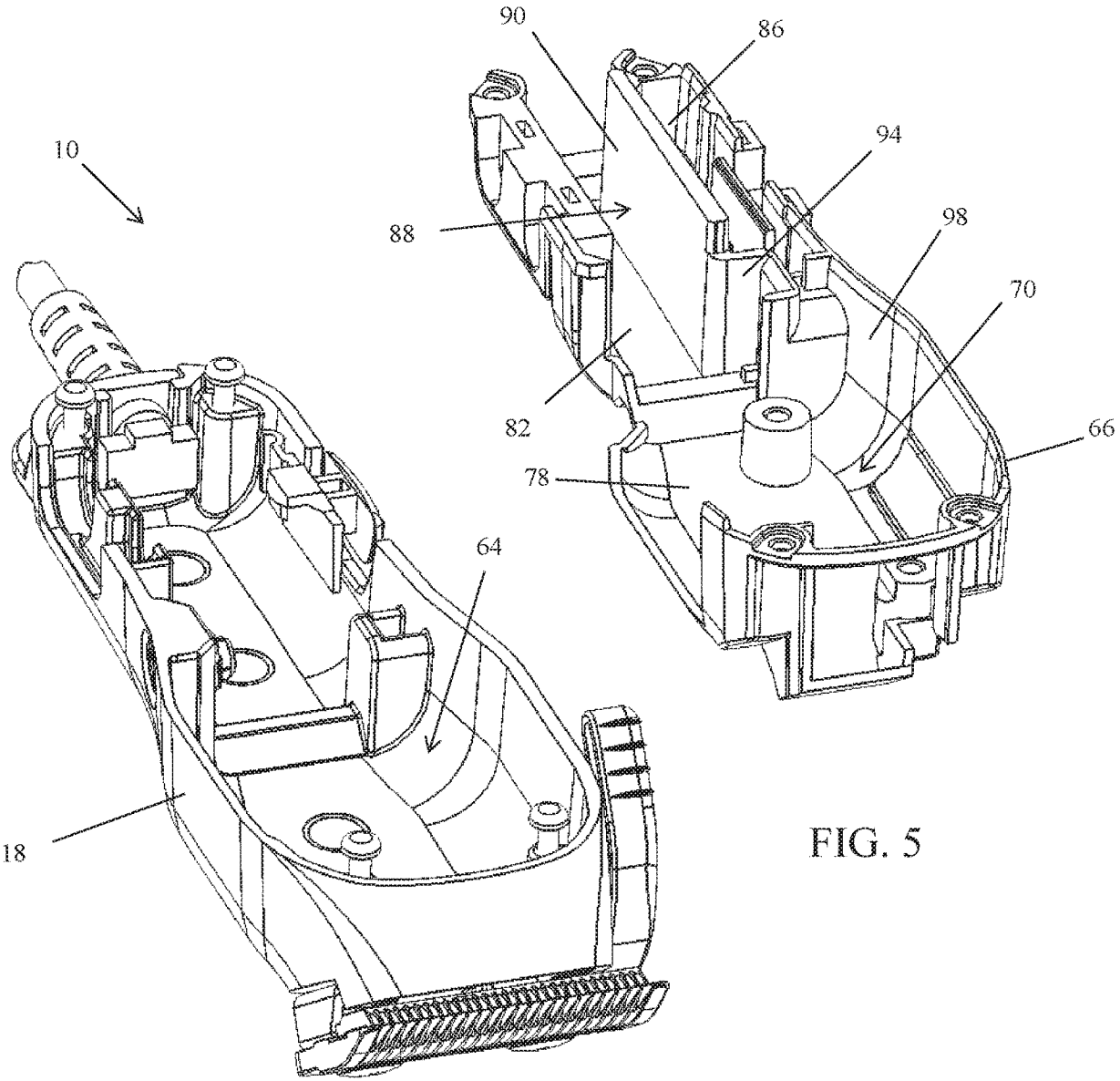
FIG. 5 is another perspective view of the hair clipper of FIG. 4 with the insulative liner removed from the lower housing.
Figure 6:
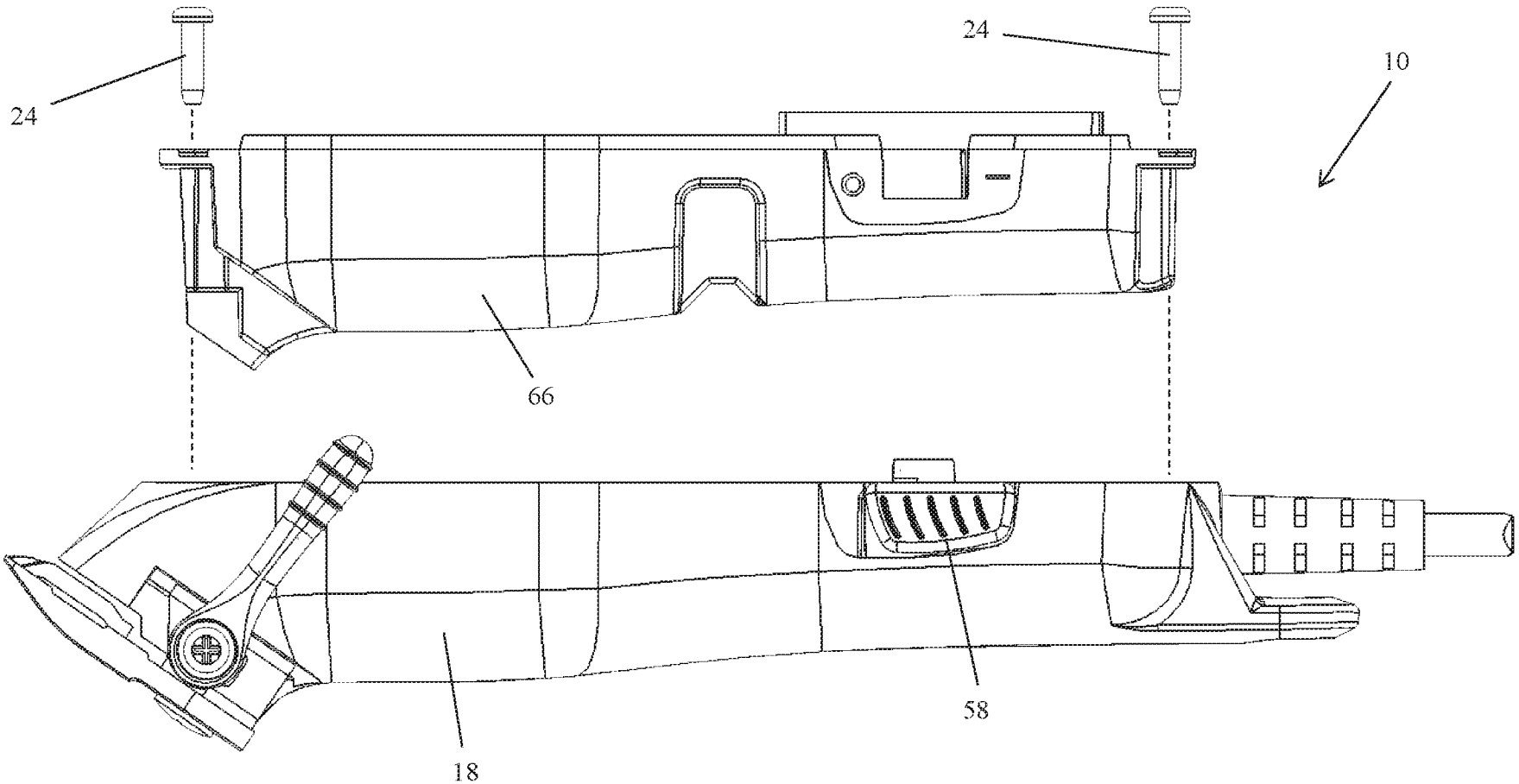
FIG. 6 is a side view of the hair clipper of FIG. 5 with the insulative liner removed from the lower housing.
Figure 7:
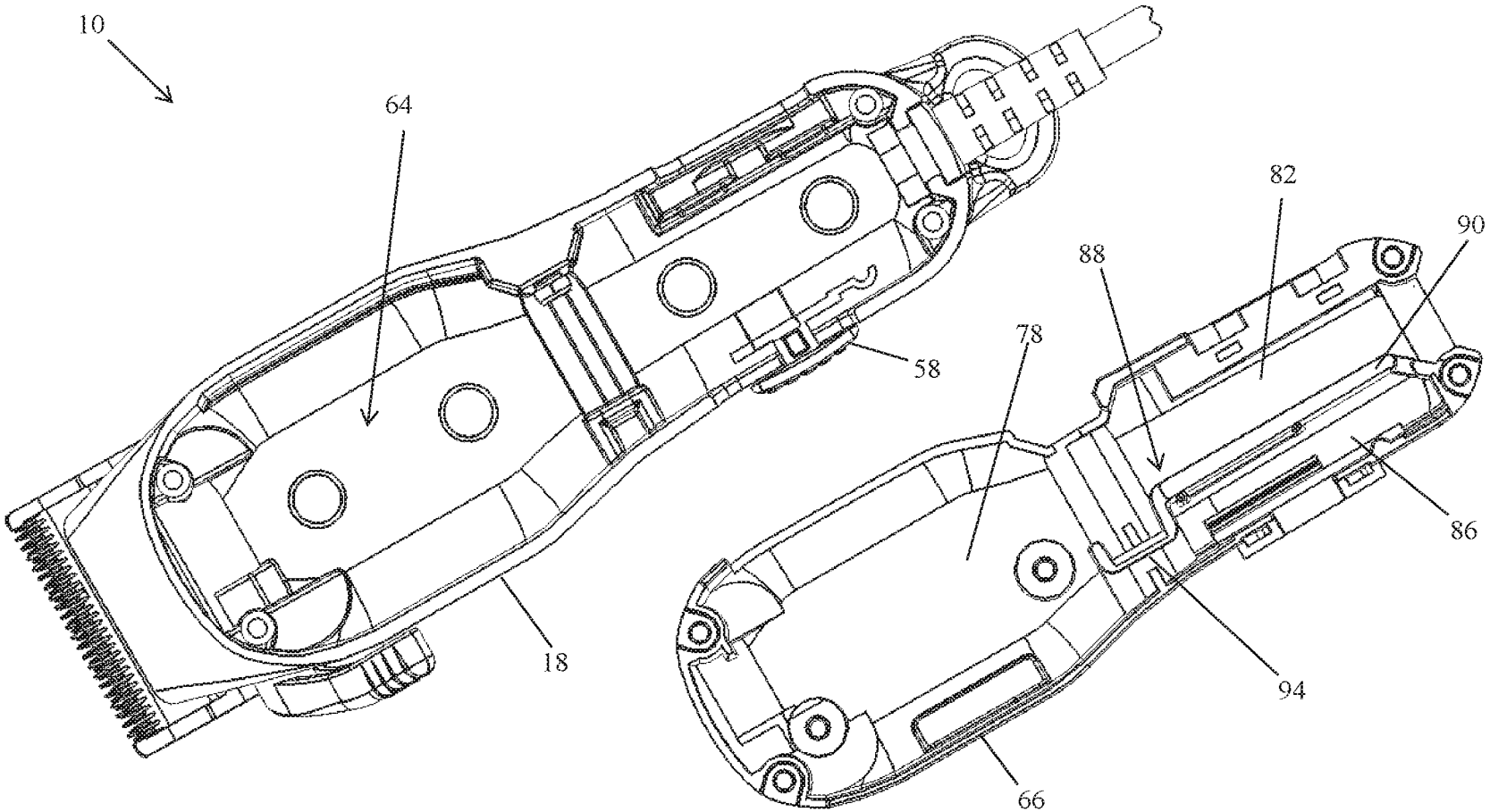
FIG. 7 is a plan view hair clipper of FIG. 5 with the insulative liner removed from the lower housing.

As shown in FIGS. 4-5, the insulative liner 66 defines a plurality of compartments 78, 82, 86. A first compartment 78 and a second compartment 82 are positioned in axial alignment, as defined by an axis extending between the first and second ends 30, 54 of the body 14. A third compartment 86 is positioned next to (or laterally offset from) the second compartment 82. A dividing wall 88 separates the third compartment 86 from the first and second compartments 78, 82. The dividing wall 88 includes a first wall portion 90 that separates, or otherwise electrically isolates, the third compartment 86 from the second compartment 82. The dividing wall 88 also includes a second wall portion 94 that connects the first wall portion 90 to a perimeter surface 98 (shown in FIG. 5) of the liner 66. The second wall portion 94 separates, or otherwise electrically isolates, the third compartment 86 from the first compartment 78. The first and second compartments 78, 82 cooperate to receive the drive assembly 42. More specifically, the first compartment 78 receives a first portion of the drive assembly 42 that includes the electric motor 62, while the second compartment 82 receives a second portion of the drive assembly 42 (shown in FIG. 2). The third compartment receives the switch 58 (also shown in FIG. 2).

The insulative liner 66 provides a barrier between the lower housing 18 (and components connected to the lower housing 18) and components positioned within the body 14. For example, the insulative liner 66 provides a barrier between the drive assembly 42, the switch 58, and the associated electrical components positioned within the body 14, and the lower housing 18. The insulative liner 66 also provides a barrier between the cutting head assembly 26 and the associated components positioned on the body 14 (e.g., on an exterior of the body 14), and the components positioned within the body 14. Further, the insulative liner 66 provides a barrier between certain components positioned within the body 14. For example, the dividing wall 88 provides a barrier between the drive assembly 42 and the switch 58 (and associated electrical components). Stated another way, a portion of the drive assembly 42, including the electric motor 62, is positioned in the first compartment 78. Another portion of the drive assembly 42 is positioned in the second compartment 82. A portion of the switch 58 and associated electrical components is positioned in the third compartment 86. The first wall portion 90 provides a barrier between the second compartment 82 and the third compartment 86, while the second wall portion 94 provides a barrier between the first compartment 78 and the third compartment 86. This barrier provides electrical insulation, thermal insulation, dampens vibration, and reduces excess sound during operation.

In the illustrated embodiment, the lower housing 18 is formed of a first material, preferably a metal or metallic material (e.g., aluminum, steel, aluminum alloy, magnesium alloy, etc.). However, in various embodiments the first material can be a plastic, polymeric material, or any other suitable material. The insulative liner 66 is formed of a second material that is different than the first material. The second material is preferably a plastic or polymeric material (e.g., a glass filled polymer, a glass filled nylon, a filled plastic or polymeric material, an unfilled plastic or polymeric material, etc.). By being formed of a polymeric material, the insulative liner 66 provides the insulative properties disclosed herein without substantially adding to the weight of the hair clipper 10. The cover 22 is formed of a third material. The third material can be the same as the first material (e.g., metal, etc.) or can be formed of a different material (e.g., carbon fiber, plastic, polymeric material, etc.).

To demonstrate the insulative properties of the hair clipper 10 having the insulative liner 66, testing was performed on a hair clipper having a plastic housing (i.e., a plastic lower housing 18) and no insulative liner 66, a hair clipper having an aluminum housing (i.e., aluminum lower housing 18) and no insulative liner 66, and the hair clipper 10 having an aluminum housing (i.e., aluminum lower housing 18) and the insulative liner 66. Stated another way, the difference between the two clippers subject to testing is the insulative liner 66. Tables 1-3 below present temperature measurements taken at three locations: at the cutting head assembly 26 (e.g., the blade set), at the housing (e.g., the lower housing 18), and at the motor coil (e.g., the electric motor 62). At each location, the temperature measurements were taken at five minute intervals during thirty minutes of continuous operation for each hair clipper, and were taken in both degrees Celsius (° C.) and degrees Fahrenheit (° F.). Table 1 presents the temperature data for the hair clipper having a plastic housing and no insulative liner 66, Table 2 presents the temperature data for the hair clipper having an aluminum housing and no insulative liner 66, while Table 3 presents the temperature data for the hair clipper having an aluminum housing and the insulative liner 66. The last lines of Tables 1-3 provide a total change in temperature (ΔT) over the thirty minute test period.

It should be appreciated that the test data presented in Tables 1-3 are the results of lab tests performed in a controlled environment to demonstrate the effect and performance of the insulative liner 66. While the tests were performed in the same manner to allow for comparison of different hair clippers (e.g., same location for temperature measurement, same time interval for operation, same controlled ambient conditions, etc.), the test data is not necessarily representative of actual conditions incurred or realized during normal operation of one or more of the hair clippers. For example, some of the temperature measurements listed below may not occur during normal operating conditions of one or more of the hair clippers.

TABLE 1

Hair Clipper with Plastic Housing and No Insulative Liner

| Minute | Blade Set (cutting head assembly 26) | | Housing (lower housing 18) | | Motor Coil (electric motor 62) | |
|---|---|---|---|---|---|---|
| Intervals | ° C. | ° F. | ° C. | ° F. | ° C. | ° F. |
| 0 (start) | 23.6 | 74.5 | 23.9 | 75.0 | 23.6 | 74.5 |
| 5 | 30.8 | 87.4 | 32.4 | 90.3 | 46.2 | 115.2 |
| 10 | 35.6 | 96.1 | 42.1 | 107.8 | 59.1 | 138.4 |
| 15 | 37.5 | 99.5 | 50.5 | 122.9 | 68.7 | 155.7 |
| 20 | 40.3 | 104.5 | 57.6 | 135.7 | 76.5 | 169.7 |
| 25 | 42.0 | 107.6 | 63.8 | 146.8 | 83.1 | 181.6 |
| 30 | 43.6 | 110.5 | 69.2 | 156.6 | 88.4 | 191.1 |
| ΔT | 20.0 | 36.0 | 45.3 | 81.5 | 64.8 | 116.6 |

TABLE 2

Hair Clipper with Aluminum Housing and No Insulative Liner

| Minute | Blade Set (cutting head assembly 26) | | Housing (lower housing 18) | | Motor Coil (electric motor 62) | |
|---|---|---|---|---|---|---|
| Intervals | ° C. | ° F. | ° C. | ° F. | ° C. | ° F. |
| 0 (start) | 24.2 | 75.6 | 24.4 | 75.9 | 24.0 | 75.2 |
| 5 | 28.6 | 83.5 | 28.4 | 83.1 | 46.1 | 115.0 |
| 10 | 32.5 | 90.5 | 32.5 | 90.5 | 57.9 | 136.2 |
| 15 | 36.2 | 97.2 | 36.5 | 97.7 | 66.1 | 151.0 |
| 20 | 39.3 | 102.7 | 39.9 | 103.8 | 72.3 | 162.1 |
| 25 | 42.3 | 108.1 | 43.0 | 109.4 | 77.1 | 170.8 |
| 30 | 44.9 | 112.8 | 45.8 | 114.4 | 81.2 | 178.2 |
| ΔT | 20.7 | 37.3 | 21.4 | 38.5 | 57.2 | 103.0 |

TABLE 3

Hair Clipper with Aluminum Housing and Having an Insulative Liner

| Minute | Blade Set (cutting head assembly 26) | | Housing (lower housing 18) | | Motor Coil (electric motor 62) | |
|---|---|---|---|---|---|---|
| Intervals | ° C. | ° F. | ° C. | ° F. | ° C. | ° F. |
| 0 (start) | 23.3 | 73.9 | 23.3 | 73.9 | 23.7 | 74.7 |
| 5 | 28.4 | 83.1 | 27.3 | 81.1 | 40.3 | 104.5 |
| 10 | 31.6 | 88.9 | 30.5 | 86.9 | 48.9 | 120.0 |
| 15 | 34.2 | 93.6 | 33.3 | 91.9 | 55.2 | 131.4 |
| 20 | 36.5 | 97.7 | 35.8 | 96.4 | 61.2 | 142.2 |
| 25 | 38.3 | 100.9 | 37.9 | 100.2 | 67.3 | 153.1 |
| 30 | 40.0 | 104.0 | 39.8 | 103.6 | 73.6 | 164.5 |
| ΔT | 16.7 | 30.1 | 16.5 | 29.7 | 49.9 | 89.8 |

As illustrated by the temperature test data in Tables 1 and 3, the insulative liner 66 resulted in a reduction in temperature at both the cutting head assembly 26 (e.g., a 5.9° F. reduction, or approximately a 16.4% reduction) and at the electric motor 62 (e.g., a 26.8° F. reduction, or approximately a 23.0% reduction), when compared to the hair clipper having a plastic housing and no insulative liner 66. Similarly, as illustrated by the temperature test data in Tables 2 and 3, the insulative liner 66 resulted in a reduction in temperature at both the cutting head assembly 26 (e.g., a 7.2° F. reduction, or approximately a 19.3% reduction) and at the electric motor 62 (e.g., a 13.2° F. reduction, or approximately a 12.8% reduction), when compared to the hair clipper having an aluminum housing and no insulative liner 66. These reductions can be attributed to the insulative liner 66 acting as a heat sink, storing heat generated by electric motor 62, and as a heat insulator, reducing the transfer of heat from the electric motor 62 to the cutting head assembly 26, and from the cutting head assembly 26 to the electric motor 62.

Most notably, the insulative liner 66 resulted in a substantial reduction in the temperature of the lower housing 18 (e.g., a 51.8° F. reduction, or approximately a 63.6% reduction), when compared to the hair clipper having a plastic lower housing 18 and no insulative liner 66 (compare Tables 1 and 3). The insulative liner 66 also resulted in a reduction in the temperature of the lower housing 18 (e.g., a 8.8° F. reduction, or approximately a 22.9% reduction), when compared to the hair clipper having an aluminum lower housing 18 and no insulative liner 66 (compare Tables 2 and 3). This reduction can be attributed to the insulative liner 66 acting as a heat sink, storing heat generated by electric motor 62, and as a heat insulator, reducing the transfer of heat from the electric motor 62 to the lower housing 18, and the transfer of heat from the cutting head assembly 26 into the components positioned in the body 14 (e.g., the motor 62, the drive assembly 42, etc.). This thermal insulation realized by the liner 66 results in a slower temperature rise and lower overall temperature of the lower housing 18, providing a comfort advantage to the user, especially to a user who holds and operates the hair clipper 10 continuously or for an extended period of time. The reduced temperature of the lower housing 18 allows the user to continue to hold and/or operate the hair clipper 10 having the insulative liner 66 without enduring adverse or uncomfortable tactile sensations caused by a high temperature (e.g., burning sensation, etc.).

In addition to the thermal insulative properties realized by insulative liner 66 (i.e., reduction in heat transfer, and/or heat retention by the liner 66), the insulative liner 66 also dampens vibration and reduces excess sound during operation of the hair clipper 10. Table 4 below presents vibration data measured at the lower housing 18 (measured in meters per second squared, or $m/s^2$) and audible sound level data (measured in decibels, or dBA) measured during operation of the hair clipper having a plastic lower housing 18 and no insulative liner 66, the hair clipper having an aluminum lower housing 18 and no insulative liner 66, and the hair clipper 10 having an aluminum lower housing 18 and the insulative liner 66. Table 4 also presents the weight of each hair clipper (measured in ounces, or oz.).

TABLE 4

| | Vibration ($m/s^2$) | Sound Level (dBA) | Weight (with Cord 50) (oz.) |
|---|---|---|---|
| Hair Clipper with Plastic Housing and No Insulative Liner | 45.7 | 71.5 | 20.4 |
| Hair Clipper with Aluminum Housing and No Insulative Liner | 36.4 | 73.1 | 23.1 |
| Hair Clipper with Aluminum Housing and Having an Insulative Liner | 35.8 | 63.0 | 22.0 |

As illustrated by the test data in Table 4, the insulative liner 66 resulted in a reduction in vibration level at the lower housing 18 (e.g., a 9.9 $m/s^2$ reduction, or approximately a 21.7% reduction) and a reduction in audible sound level (e.g., an 8.5 dBA reduction, or approximately an 8.5% reduction), when compared to the hair clipper having a plastic lower housing 18 and no insulative liner 66. Further, the insulative liner 66 minimally increased the total weight of the hair clipper (e.g., only a 1.6 oz. increase in weight, or a 7.2% increase). The insulative liner 66 resulted in a reduction in vibration level at the lower housing 18 (e.g., a 0.6 $m/s^2$ reduction, or approximately a 1.6% reduction) and a reduction in audible sound level (e.g., a 10.1 dBA reduction, or approximately a 13.8% reduction), when compared to the hair clipper having an aluminum lower housing 18 and no insulative liner 66. Further, the insulative liner 66 decreased the total weight of the hair clipper (e.g., a 1.1 oz. decrease in weight, or a 4.7% decrease). The approximately 5.0% decrease in weight is realized by a reduction in aluminum (or associated metal) in the lower housing 18. Thus, the insulative liner 66 allows for a reduction in the weight of the lower housing 18. In other embodiments, the insulative liner 66 can result in a decrease in total weight of at least 5.0%, and/or more than 5.0%.

The reductions in vibration and sound above can be attributed to the insulative liner 66 providing vibration dampening and sound absorption (a reduction in excess sound) during hair clipper operation. The reduction in vibration advantageously allows the user to continue to hold and/or operate the hair clipper 10 having the insulative liner 66 without enduring adverse or uncomfortable tactile sensations caused by vibration transferred to the user's hand (e.g., discomfort or pain from grasping a vibrating device, etc.). The reduction in audible noise emitted by the hair clipper 10 reduces the decibel exposure to the user during operation of the hair clipper 10.

The insulative liner 66 also provides electrical insulation by providing a barrier between certain electrical components positioned within the body 14 (e.g., the drive assembly 42, the switch 58, etc.) and the lower housing 18. This barrier reduces the risk of electrical shock to the user. In addition, the insulative liner 66 also provides electrical insulation between certain electrical components positioned within the body 14 (e.g., the drive assembly 42 and the switch 58 by the dividing wall 88, etc.). This barrier reduces the risk of an electrical short between electrical components.

Thus, the invention provides, among other things, a liner for a hair clipper that provides electrical insulation, thermal insulation, dampens vibration, and reduces excess sound during hair clipper operation. The liner also does not significantly alter the weight of the hair clipper, meaning the user can realize the advantages of the liner without enduring a substantially heavier hair clipper. Various additional features and advantages of the invention are set forth in the following claims.

What is claimed is:

1. A hair grooming device comprising:

a body that includes a lower housing and a removable cover, the lower housing defining a hollow cavity, the lower housing formed of a first material;

a liner received by the lower housing in the cavity, the liner formed of a second material, wherein the second material is different than the first material;

a drive assembly positioned within the cavity, the liner positioned between the drive assembly and the lower housing; and a blade assembly coupled to the drive assembly, the blade assembly comprising a first blade and a second blade, wherein the drive assembly is configured to oscillate the first blade relative to the second blade to cut hair;

wherein the liner includes a first compartment and a second compartment, wherein the drive assembly is received in the first compartment that is electrically isolated from the second compartment.

2. The hair grooming device of claim 1, wherein the second material is plastic.

3. The hair grooming device of claim 2, wherein the plastic is glass filled nylon.

4. The hair grooming device of claim 2, wherein the first material is metal.

5. The hair grooming device of claim 2, wherein the first material is aluminum.

6. The hair grooming device of claim 5, wherein the liner increases a thermal resistance between the first compartment and the second compartment.

7. The hair grooming device of claim 2, wherein the first material is plastic.

8. The hair grooming device of claim 1, wherein the drive assembly includes an electric motor.

9. The hair grooming device of claim 1, wherein the liner is configured to reduce the transfer of heat generated by the drive assembly to the lower housing.

10. The hair grooming device of claim 1, wherein the liner is configured to absorb heat generated by the drive assembly.

11. The hair grooming device of claim 1, wherein the liner is configured to reduce the transfer of heat generated by the blade assembly to the drive assembly.

12. The hair grooming device of claim 1, wherein the liner is configured to dampen vibration generated by the drive assembly by reducing the transfer of vibration from the drive assembly to the lower housing.

13. The hair grooming device of claim 1, wherein the liner is configured to reduce sound by absorbing sound generated by the drive assembly.

14. The hair grooming device of claim 1, wherein the liner is configured to electrically insulate the drive assembly and the lower housing by limiting the transfer of electricity there between.

15. The hair grooming device of claim 1, wherein the first and second compartments are electrically isolated by a dividing wall.

16. The hair grooming device of claim 1, further comprising a switch positioned in the second compartment, a portion of the switch being mounted on the lower housing to facilitate user actuation.

17. The hair grooming device of claim 1, further comprising a third compartment, and a dividing wall, a portion of the drive assembly is positioned in the second compartment, and a portion of a switch is positioned in the third compartment, the first and second compartments being electrically isolated from the third compartment by the dividing wall.

18. The hair grooming device of claim 1, wherein the hair grooming device is one of a hair clipper or a hair trimmer.

19. A hair grooming device comprising:

a body that includes a lower housing and a removable cover, the lower housing defining a hollow cavity, the lower housing formed of a first material;

a liner received by the lower housing in the cavity, the liner formed of a second material, wherein the second material is different than the first material;

a drive assembly positioned within the cavity, the liner positioned between the drive assembly and the lower housing; and a blade assembly coupled to the drive assembly, the blade assembly comprising a first blade and a second blade, wherein the drive assembly is configured to oscillate the first blade relative to the second blade to cut hair;

wherein the liner includes a first compartment, a second compartment, a third compartment, and a dividing wall, a first portion of the drive assembly is positioned in the first compartment, a second portion of the drive assembly is positioned in the second compartment, and a portion of a switch is positioned in the third compartment, the first and second compartments being electrically isolated from the third compartment by the dividing wall.

20. The hair grooming device of claim 19, wherein the second material is plastic.

21. The hair grooming device of claim 20, wherein the plastic is glass filled nylon.

22. The hair grooming device of claim 20, wherein the first material is metal.

23. The hair grooming device of claim 20, wherein the first material is aluminum.

24. The hair grooming device of claim 23, wherein the liner increases a thermal resistance between the first, second, and third compartments.

25. The hair grooming device of claim 20, wherein the first material is plastic.

26. The hair grooming device of claim 19, wherein the drive assembly includes an electric motor.

27. The hair grooming device of claim 19, wherein the liner is configured to reduce the transfer of heat generated by the drive assembly to the lower housing.

28. The hair grooming device of claim 19, wherein the liner is configured to absorb heat generated by the drive assembly.

29. The hair grooming device of claim 19, wherein the liner is configured to reduce the transfer of heat generated by the blade assembly to the drive assembly.

30. The hair grooming device of claim 19, wherein the liner is configured to dampen vibration generated by the drive assembly by reducing the transfer of vibration from the drive assembly to the lower housing.

31. The hair grooming device of claim 19, wherein the liner is configured to reduce sound by absorbing sound generated by the drive assembly.

32. The hair grooming device of claim 19, wherein the liner is configured to electrically insulate the drive assembly and the lower housing by limiting the transfer of electricity there between.

33. The hair grooming device of claim 19, wherein the hair grooming device is one of a hair clipper or a hair trimmer.

* * * * *